US005803560A

United States Patent [19]

Trulaske, Sr. et al.

[11] Patent Number: 5,803,560

[45] Date of Patent: Sep. 8, 1998

[54] CURVED FRONT CONSTRUCTION FOR A MERCHANDISER

[75] Inventors: Steven L. Trulaske, Sr., Ladue; Robert J. Trulaske, Sr., St. Louis, both of Mo.

[73] Assignee: True Manufacturing Co., Inc., O'Fallon, Mo.

[21] Appl. No.: 752,160

[22] Filed: Nov. 18, 1996

Related U.S. Application Data

[63] Continuation-in-part of Ser. No. 324,230, Oct. 17, 1994, Pat. No. 5,584,547.

[51] Int. Cl.[6] ..... A47B 97/00; A47F 3/04

[52] U.S. Cl. ..... 312/223.5; 312/116; 40/575; 40/573; D6/472

[58] Field of Search ..... 312/223.5, 204, 312/114, 116, 401, 406.2; 40/575, 573; 362/223, 260; D6/472

[56] References Cited

U.S. PATENT DOCUMENTS

| | | | |
|---|---|---|---|
| D. 318,071 | 7/1991 | Sullivan | D20/5 |
| D. 350,245 | 9/1994 | Branz et al. | D6/472 |
| D. 363,398 | 10/1995 | Branz et al. | D6/472 |
| 5,255,968 | 10/1993 | Craven | 40/575 X |
| 5,277,486 | 1/1994 | Bustos | 312/116 V |
| 5,509,225 | 4/1996 | Minh et al. | 40/575 X |
| 5,542,554 | 8/1996 | Resnick | 312/223.5 X |
| 5,567,026 | 10/1996 | Lacewell | 312/116 X |
| 5,584,547 | 12/1996 | Trulaske, Sr. | 312/223.5 |
| 5,584,566 | 12/1996 | Bowman et al. | 40/573 X |
| 5,607,211 | 3/1997 | Henninger et al. | 312/204 |

*Primary Examiner*—James R. Brittain
*Assistant Examiner*—Rodney B. White
*Attorney, Agent, or Firm*—Cohn, Powell & Hind

[57] ABSTRACT

This curved front construction for a merchandiser (10) includes a door (22) having opposed side framing members (30) upper and lower framing members (31) and (32) and a flat glass panel (48) held in place by said members. Each of the side members (30) has retainer flanges (50) and each of the upper and lower framing members (31) and (32) is provided with arcuate retainer members (160) and (161) for retaining an outwardly disposed clear arcuate plastic sheet (52) in overlapping relation. The construction also includes an arcuate display panel disposed (24) above the door (22) and an arcuate grill panel (26) disposed below the door.

14 Claims, 5 Drawing Sheets

CURVED FRONT CONSTRUCTION FOR A MERCHANDISER

This application is a continuation-in-part of application Ser. No. 0 8/324,230 filed on Oct. 17,1994 now U.S. Pat. No. 5,584,547.

BACKGROUND OF THE INVENTION

This invention relates generally to refrigerated coolers of the type known as glass door merchandisers and particularly to a merchandiser having a curved front construction.

Merchandisers of the type under consideration are usually found in supermarket express lane checkout aisles, hotel lobby stores, health clubs and similar locations. In addition to being convenient and accessible and providing maximum interior storage space it is important that they be eye-appealing to the customer in exterior appearance. Since the utilitarian requirements and cost effectiveness are important considerations, merchandisers tend to be rectangular blocks, having an essentially flat glass door at the front and sometimes at the rear, flat ends and a flat top. The flat door appearance is a reflection of the interior space and it is desirable in some instances to provide an alternative which is attractive yet preserves the utilitarian aspects of the interior space. Vending machines are known such as U.S. Pat. No. D294,716 which have rounded front panels and U.S. Pat. Nos. D294,718 and D318,071 which have combined rounded front panels and side panels. Merchandisers are known such as U.S. Pat. No. D363,398 which have partially rounded fronts, for example, the upper display panel and the grill and a flat access door. Vending cabinets and beverage dispensers, such as U.S. Pat. Nos. D121,761, D300,595, and D350,245 respectively, are also known which have rounded ends and/or fronts but these configurations are virtually semi-circular and, structurally, the exterior appearance reflects the interior space and the rounded doors may be sliding doors. A co-owned patent application Ser. No. 08/324,230, now U.S. Pat. No. 5,584,547, is also known which provides a curved end construction. All of these patents and the application are incorporated herein by reference.

The present invention utilizes a curved front door, grill and display panel construction, which permits the provision of rounded front on a merchandiser in a manner not revealed in the known prior art.

SUMMARY OF THE INVENTION

This invention provides a refrigerated merchandiser having a curved front construction without altering the interior capacity or arrangement of the unit. The construction includes an arcuate door and may also include an arcuate display panel and grill This curved front construction for a merchandiser comprises a door including opposed elongate side members having first retaining means and second retaining means; a flat glass panel extending between said side members and held in place by one of said retaining means; and an arcuate sheet of clear plastic material extending between said side members and disposed outwardly of said glass panel, said sheet being held in place by the other of said retaining means. The door also includes upper and lower elongate members each having first retaining means for said glass panel and second retaining means for said arcuate sheet, said glass panel and said sheet extending between said upper and lower members.

It is an aspect of this invention to provide that the opposed side members each includes a base portion and an outstanding flange portion providing said arcuate sheet retaining means and receiving said arcuate sheet in overlapping relation.

It is another aspect of this invention to provide that the flange portions are unitarily formed with said base portions.

Still another aspect of this invention is to provide that the opposed upper and lower members each includes a base portion and an arcuate portion attached to said base portion and providing said arcuate sheet retaining means and receiving said arcuate sheet in overlapping relation.

Yet another aspect of this invention is to provide that the arcuate portion is provided by an ell-shaped member.

It is an aspect of this invention to provide that each ell-shaped member includes an arcuate front portion and a substantially flat rear portion attached to the associated base portion of one of said upper and lower members.

It is an aspect of this invention that the second retaining means includes an arcuate strip of adhesive material facilitating the holding of the flexed arcuate sheet in place.

It is still another aspect of this invention is to provide that a curved display panel is disposed above the door, and another aspect to provide that the display panel includes a hollow body defining a curved frame and an arcuate sheet having substantially the same curvature as the arcuate sheet retained by the door.

It is yet another aspect of this invention to provide that a curved grill panel is disposed below the door, and another aspect to provide that the grill panel includes a hollow body having opposed sides and a plurality of arcuate louvre members extending therebetween and having substantially the same curvature as the arcuate sheet retained by the door frame.

It is an aspect of this invention to provide a merchandiser with a curved front construction, which is relatively simple and inexpensive to manufacture and effective for its intended purpose.

DESCRIPTION OF THE PREFERRED EMBODIMENT

Figure 3:
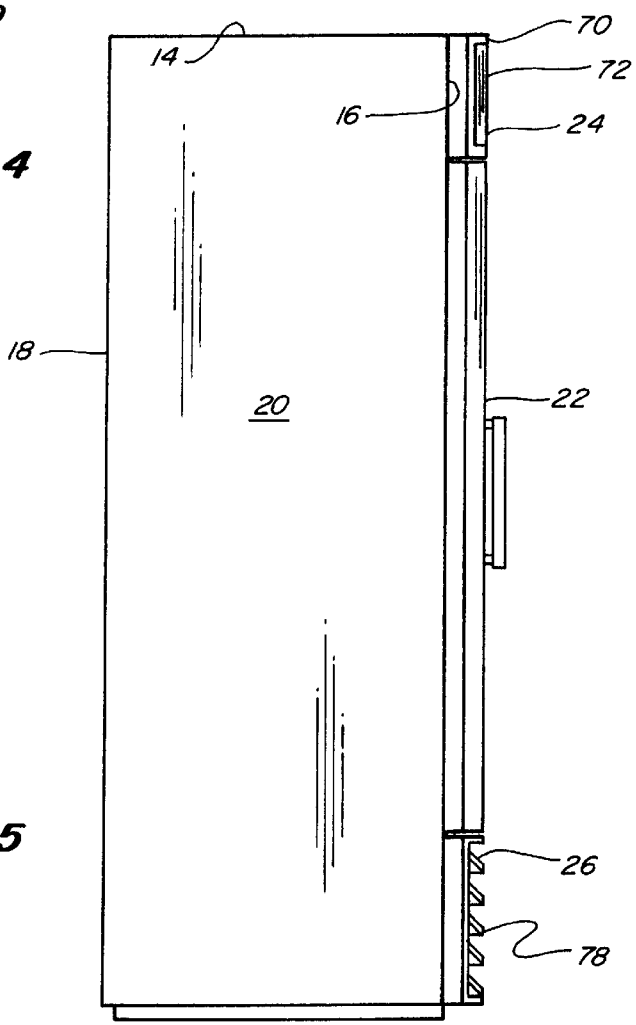
FIG. 3 is an end view thereof.

Referring now by reference numerals to the drawings and first to FIGS. 1–5 it will be understood that the merchandiser 10 includes a body 12 having a top wall 14, a front wall 16, a rear wall 18 and end walls 20. The front wall 16 defines an access opening provided with a door 22, and includes an upper portion providing a display panel 24 and lower portion providing a grill panel 26.

Figure 4:
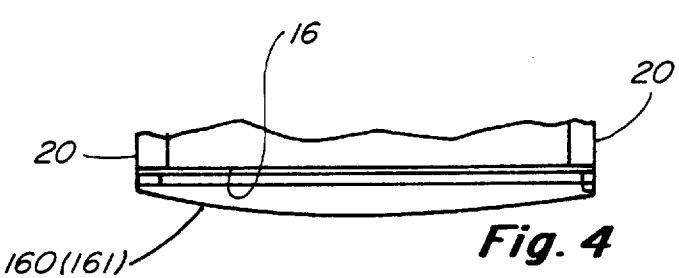
FIG. 4 is a fragmentary cross-sectional view taken on line 4—4 of FIG. 1.
Figure 5:
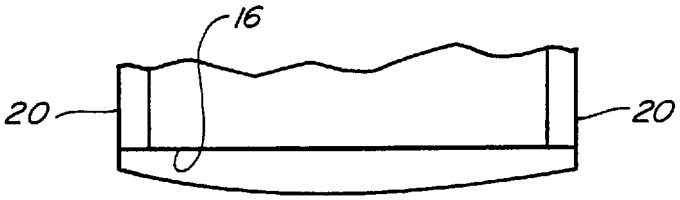
FIG. 5 is a fragmentary cross-sectional view taken on line 5—5 FIG. 1.
Figure 2:
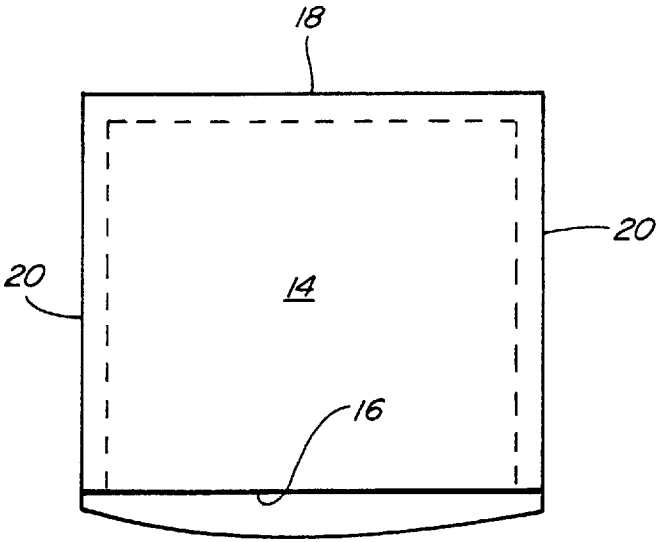
FIG. 2 is a plan view thereof.

The access door 22, the display panel 24 and the grill panel 26 are all curved at the front and, as shown by reference to FIGS. 2, 4 and 5 have substantially the same curvature to present a uniform arcuate face to the merchandiser front as a whole.

The details of the access door 22 will now be described with reference to FIGS. 6–9. Except for the handle and the hinge, the door 22 is substantially symmetrical and includes opposed elongate vertical framing members 30 and upper and lower horizontal framing members 31 and 32 respectively. Each of the vertical members 30 includes a generally U-shaped base portion 34 formed, in the embodiment shown, of extruded aluminum, or the like, having a bight portion 36 arms 38 and 39 having inturned lips. The members 30 also include an extension flange 40 at the end of one arm 39 and a thickened portion 42 on said arm 39. The vertical member 30 also includes an elongate keep member 44 which is attached to arm 38, as by screws (not shown). The keep member 44 includes a flange portion 46 which cooperates with the flange 40 to hold an insulation glass panel 50 in place and constitutes a first retaining means. The keep member 44 also includes a channel portion 45 which receives a door seal 47 which abuts the front wall 16. The vertical member 30 also includes an inwardly inclined corner flange 50 which cooperates with the arm 39 to receive an arcuate plastic sheet 52 and constitutes a second retaining means. In the embodiment shown, the arcuate plastic sheet 52 is preferably formed from a clear flexible material such as Lexan.

Figure 8:
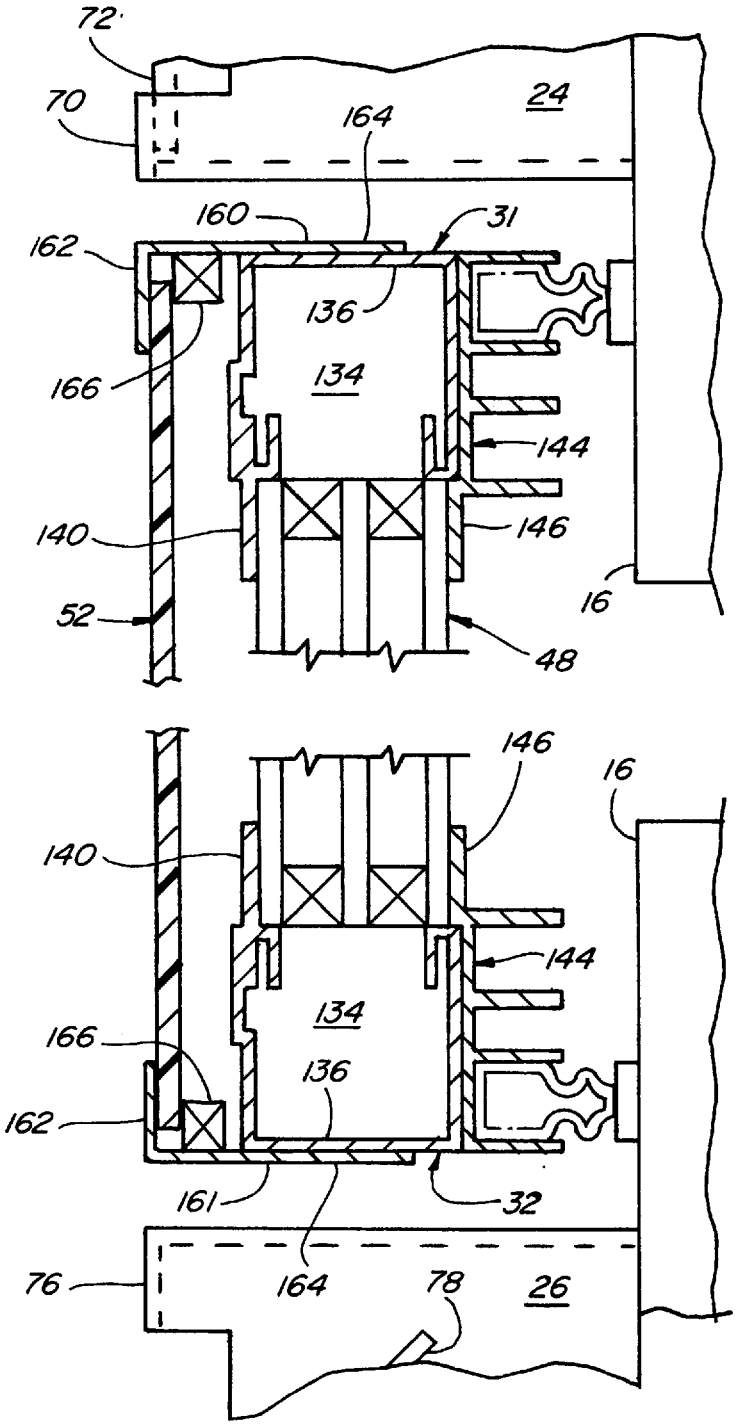
FIG. 8 is a fragmentary cross-sectional view taken on line 8—8 of FIG. 7.

The upper and lower door framing members 31 and 32, although of different length, are substantially identical to the vertical members 30 in that they include a generally U-shaped extruded base portion, except that the base portion indicated by numeral 134, does not have the inwardly inclined corner flange 50. Accordingly, corresponding parts of the upper and lower members 31 and 32 shown in FIG. 8 are given the same reference numerals, but with a prefix "1", and perform the same function as described above with reference to the side members 30 shown in FIG. 6. As shown in FIG. 8, the base portion 134 of upper and lower members 31 and 32 includes flange 140. As with side members 30, elongate keep member 144 is provided having a flange 146 cooperating with flange 140 to provide a first retaining means for the glass panel 48.

In lieu of the retaining flanges 50 of side members 30 holding the side margins of the arcuate sheet 52 in place, opposed upper and lower cap and base members 160 and 161, respectively, attached to the upper and lower members 31 and 32 are provided holding the upper and lower margins of the arcuate sheet 52 in place and constitute second retaining means. As shown by reference to FIGS. 4 and 6–9 the cap and base members 160 and 161 are ell-shaped and each includes an arcuate outer flange 162 and a flat flange 164 attached to the bight member 136 of the upper and lower members 31 and 32 as by screws (not shown). In order to ensure that the upper and lower margins of the plastic sheet 52 are held securely in place, an elongate strip of adhesive tape 166 is provided, which is adhesively pressed into place on the inside of the flange 64 of each of the upper and lower members 160 and 161 and holds the arcuate sheet into abutting conformity with the arcuate front flange 162.

The curved front display panel 24 disposed above the door 22 provides a hollow body defining a curved frame 70 for an arcuate sheet 72 of flexible material such as Lexan. The sheet 72 is adhesive or otherwise attached to the inside of the panel as by adhesive strips such as those used for holding the door arcuate sheet 52 in place. Preferably, the arcuate sheet has substantially the same curvature as the door arcuate sheet 52. The display panel preferably includes fluorescent tubes or the like (not shown) to back-light the arcuate display sheet.

The curved front grill panel 26 disposed below the door provides a hollow body defining a curved frame 76 and a plurality of inclined louver members 78. The louver members are preferably curved in plan at substantially the same curvature as the door arcuate sheet 52.

In the embodiment shown, the display panel 24 and the grill panel are attached to the merchandiser body front by any suitable means such as by elongate screws, (not shown) passing through the respective frames of said display panel and grill panel.

It is thought that the structural features and functional advantages of this curved front merchandiser 30 have become fully apparent from the foregoing description of parts but for completeness of disclosure the installation of the assembly will be briefly described.

Figure 6:
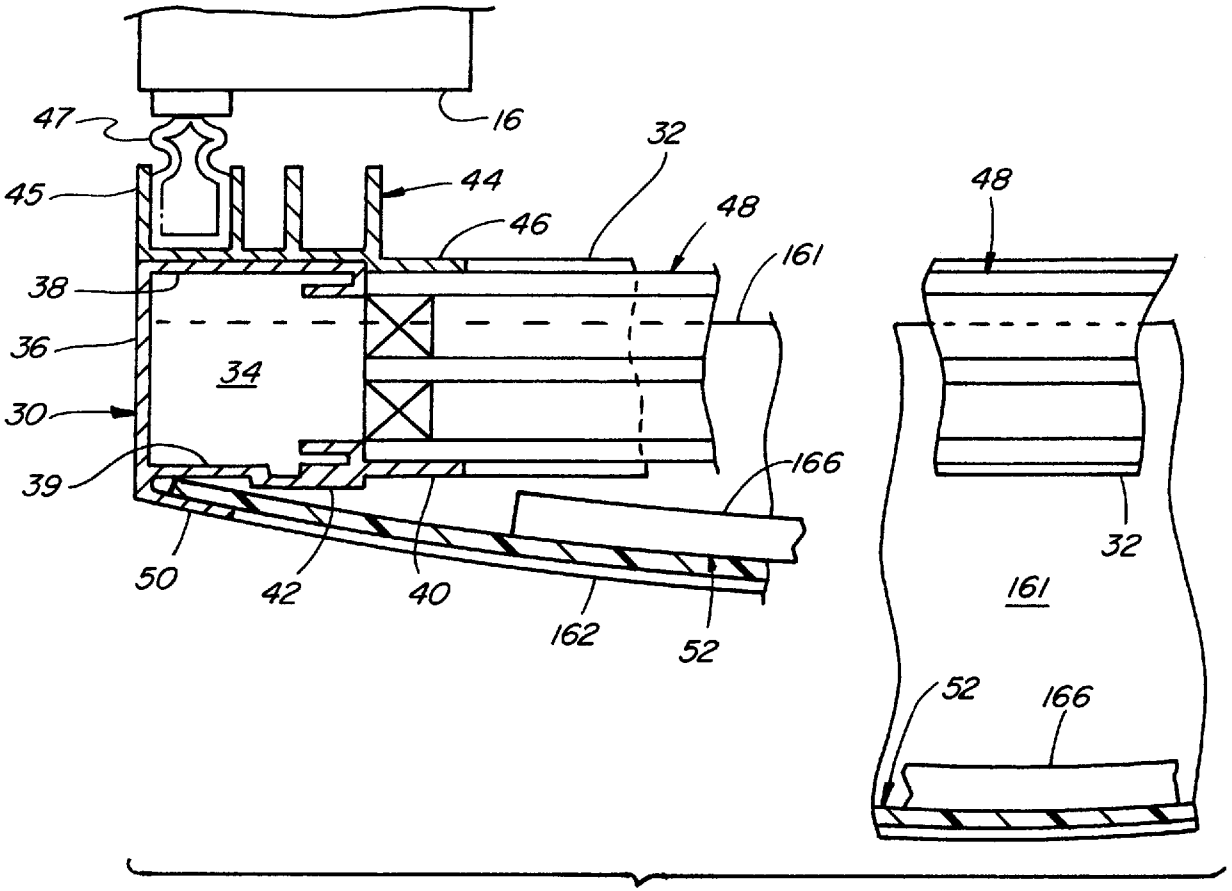
FIG. 6 is an enlarged fragmentary cross-sectional view taken on line 6—6 of FIG. 1.
Figure 9:
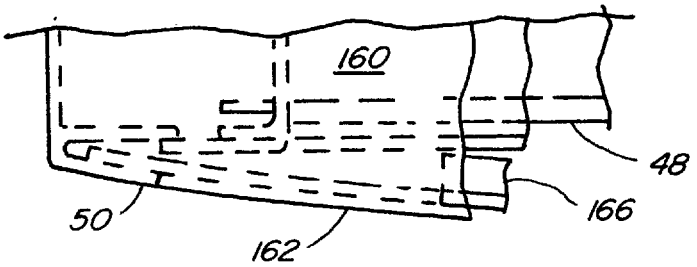
FIG. 9 is a fragmentary plan view of the door.
Figure 7:
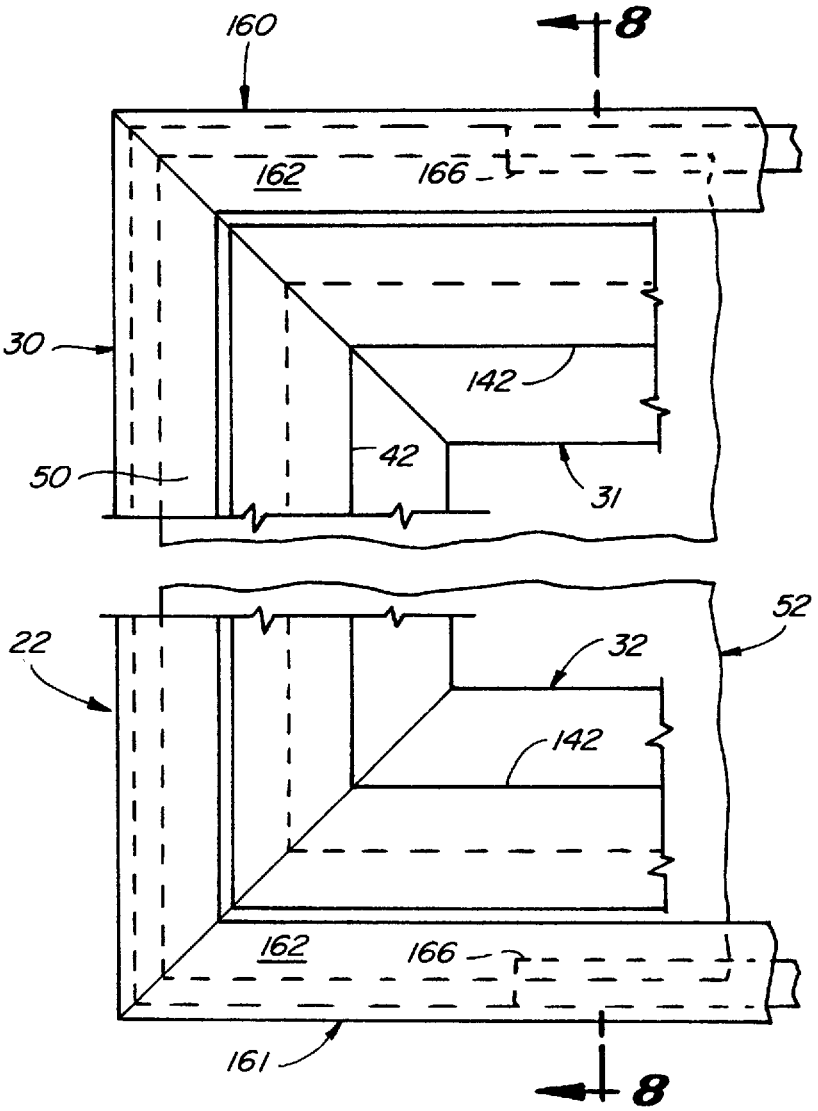
FIG. 7 is a fragmentary elevational view of the door.

As best shown in FIGS. 1 and 6–8 the door 22 is constructed in similar fashion to a door having a flat face provided by the clear glass panel 48 framed by side members 30 and upper and lower members 31 and 32. The curvature of the door is achieved, not by curving the glass of the panel 48 and the upper and lower framing members 31 and 32, but by adding a lightweight, but strong curved fascia sheet which, in the embodiment shown, may be a sheet of plastic such as Lexan. The side margins of the arcuate sheet 52 are held in place by providing the side members 30 with inwardly inclined retainer flanges 50. The upper and lower margins of the sheet 52 are held in place by arcuate cap and base members 160 and 161 attached to the upper and lower members 31 and 32. The lightweight flexible nature of the sheet 52 permits it to be easily flexed and slipped behind the retainer flanges 50. The door construction is such that the plastic sheet 52 can be installed before the glass panel 48 is installed, that is before the keep members 44 are emplaced. In this way, the base retaining member 161 may first be attached to the door lower member 32 the sheet 52 flexed, emplaced behind the side flanges 50 and slid down to the position shown in FIG. 8 within the base member 161. Following the cap retaining member may be attached to the upper member 31 and the upper and lower adhesive strips 166 pressed into position to hold the upper and lower margins of plastic sheet in place as also shown in FIG. 8. After the plastic sheet 52 is installed it is a simple matter to install the glass panel 48 and the keep members 44 and 144. When the door installation is completed the arcuate flanges 162 of the upper and lower members, which are mitered, fit the mitered ends of the inclined retainer flanges 50 as shown in FIGS. 6, 7 and 9. The simplicity of this arrangement ensures that should the plastic sheet 52 become scuffed or damaged it can readily be replaced by reversing the installation procedure described above.

Figure 1:
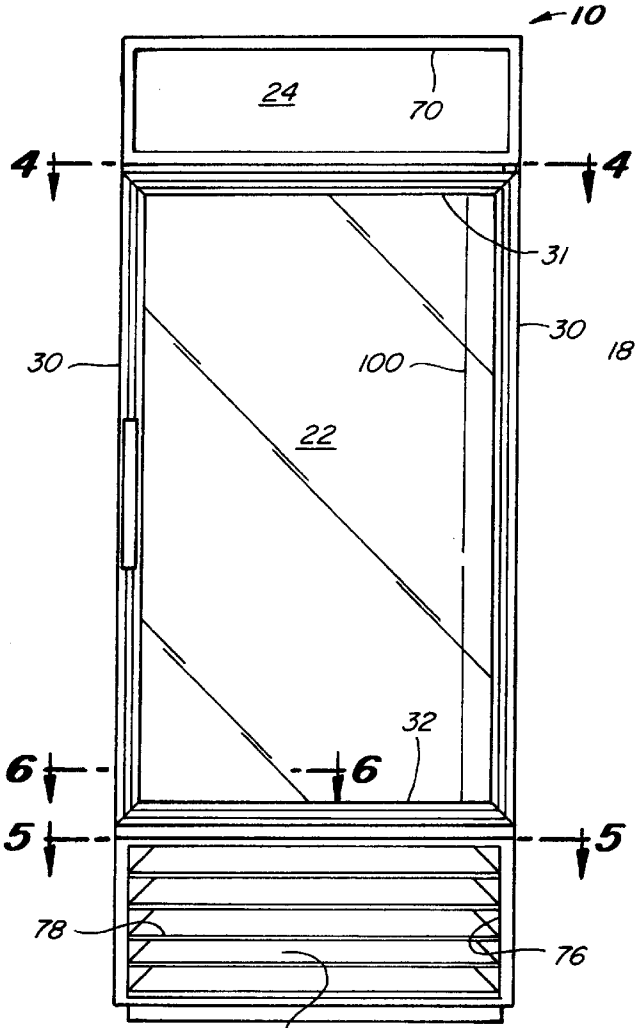
FIG. 1 is a front elevational view of the merchandiser.

The upper display panel 24, and lower grill panel 26, are easily installed by means of elongate machine screws (not shown) which can be readily attached, for example, to predrilled openings provided in the merchandiser front wall 16. Although not discussed herein, the curved front construction can readily be adapted to a door having an integrated light attachment indicated 100 such as shown in co-owned application Ser. No. 08/536,465 which is incorporated herein by reference. If an integrated light attachment is used a filler 100 shown in phantom outline in FIG. 1 is disposed between the glass panel and the hinge end side member 30 and effectively becomes a part of the vertical door frame member.

Also, a clear plastic material is preferred for the arcuate sheet but this is not to be understood to mean that decoration, such as the name of the beverage, e.g., "Coke" or the like cannot be used, so long as there is an substantially clear viewing area for the merchandise.

Although the invention has been described by making detailed reference to the preferred embodiments, such detail is to be understood in an instructive rather than in any restrictive sense, many other variants being possible within the scope of the claims hereunto appended.

I claim as my invention:

1. A curved front construction for a merchandiser comprising:

(a) a door including opposed elongate side members, each of said side members having first retaining means and second retaining means;

(b) a flat glass panel extending between said side members and held in place by one of said retaining means; and (c) an arcuate sheet of substantially clear plastic material extending between said side members and disposed outwardly of said glass panel, said sheet being held in place by the other of said retaining means.

2. A construction as defined in claim 1, in which:

(d) the opposed side members each includes a base portion and outstanding flange portions providing said arcuate sheet retaining means and receiving said arcuate sheet in overlapping relation.

3. A construction as defined in claim 2, in which:

(f) the flange portions are unitarily formed with said base portions.

4. A curved front construction for a merchandiser comprising:

(a) a door including opposed elongate side members having first retaining means and second retaining means;

(b) a flat glass panel extending between said side members and held in place by one of said retaining means; and (c) an arcuate sheet of substantially clear plastic material extending between said side members and disposed outwardly of said glass panel, said sheet being held in place by the other of said retaining means, (d) the door including upper and lower elongate members each having first retaining means for said glass panel and second retaining means for said arcuate sheet, said glass panel and said sheet extending between said upper and lower members.

5. A construction as defined in claim 4, in which:

(e) the opposed upper and lower members each includes a base portion and an arcuate portion attached to said base portion and providing said arcuate sheet retaining means and receiving said arcuate sheet in overlapping relation.

6. A construction as defined in claim 5, in which:

(f) the arcuate portion is provided by an ell-shaped member.

7. A construction as defined in claim 6, in which:

(g) each ell-shaped member includes an arcuate front portion and a substantially flat rear portion attached to the associated base portion of one of said upper and lower members.

8. A construction as defined in claim 1, in which:

(d) a curved display panel is disposed above the door.

9. A construction as defined in claim 8, in which:

(e) the display panel includes a hollow body defining a curved frame and an arcuate sheet having substantially the same curvature as the arcuate sheet retained by the door.

10. A construction as defined in claim 1, in which:

(d) a curved grill panel is disposed below the door.

11. A construction as defined in claim 10, in which:

(e) the grill panel includes a hollow body having opposed sides and a plurality of arcuate louver members extending therebetween and having substantially the same curvature as the arcuate sheet retained by the door.

12. A curved front construction for a merchandiser comprising:

(a) a door including opposed elongate side members and upper and lower elongate members each having first retaining means and second retaining means;

(b) a flat glass panel extending between said side members and said upper and lower members and held in place by said first retaining means;

(c) an arcuate sheet of substantially clear plastic material extending between said side members and said opposed upper and lower members and having opposed side margins and upper and lower margins and held in place by said second retaining means; and (d) said second retaining means includes an inwardly directed flange provided on each of said opposed side members and receiving said arcuate sheet side margins in overlapping relation and upper and lower ell-shaped arcuate members attached to each of said upper and lower members and having an arcuate front member receiving said flexed arcuate sheet upper and lower margins in overlapping relation.

13. A construction as defined in claim 12, in which:

(e) said second retaining means includes an arcuate strip of adhesive material facilitating the holding of the flexed arcuate sheet in place.

14. A construction as defined in claim 12, in which:

(f) a curved display panel is disposed above the door and a curved grill panel is disposed below the door, said panels having substantially the same curvature of the arcuate sheet retained by the door.

* * * * *